United States Patent [19]

Shiraiwa et al.

[11] 4,016,066

[45] Apr. 5, 1977

[54] METHOD FOR RAPID COOLING OF THERMALLY CRACKED GASES OF HYDROCARBONS AND APPARATUS FOR CARRYING OUT THE METHOD

[75] Inventors: Masatoyo Shiraiwa; Ichiro Tokumitsu, both of Tokyo; Toshisada Takemura, Ichikawa; Satoshi Hatano, Kudamatsu; Hiroshi Yamaguchi, Tokyo, all of Japan

[73] Assignee: Idemitsu Sekiyukagaku Kabushiki Kaisha (Idemitsu Petrochemical Co., Ltd.), Tokyo, Japan

[22] Filed: Apr. 21, 1975

[21] Appl. No.: 569,930

Related U.S. Application Data

[63] Continuation of Ser. No. 393,212, Aug. 30, 1973, abandoned.

[30] Foreign Application Priority Data

Aug. 31, 1972 Japan ..... 47-86635

[52] U.S. Cl. ..... 208/48 Q; 165/104 R; 165/106; 208/106; 260/683 R

[51] Int. Cl.[2] ..... C10G 9/16

[58] Field of Search ..... 208/48 R, 48 Q, 106; 260/683 R; 165/107, 104 R, 104 M, 106

[56] References Cited

UNITED STATES PATENTS

| | | | |
|---|---|---|---|
| 1,877,060 | 9/1932 | Schonberg | 208/106 |
| 2,075,896 | 4/1937 | Harmon | 208/85 |
| 2,162,300 | 6/1939 | Farrell et al. | 208/48 R |
| 2,832,733 | 4/1958 | Szilard | 176/52 |
| 3,008,271 | 11/1961 | Cook et al. | 165/107 |
| 3,647,907 | 3/1972 | Sato et al. | 260/683 R |

*Primary Examiner*—Herbert Levine
*Attorney, Agent, or Firm*—William J. Daniel

[57] ABSTRACT

A method for rapid cooling of high temperature reaction gases obtained by thermal cracking of hydrocarbons, which comprises conducting an indirect heat exchange between a high temperature reaction gas obtained by thermal cracking of a hydrocarbon and a molten metal maintained at a prescribed temperature, lest heavy components in the high temperature gas be substantially condensed. In this method, the molten metal can be circulated by the use of a pressurized inert gas. In practice of this method, there can be effectively used a high temperature reaction gas cooling apparatus comprising a double-tubular heat exchanger, a cooling tank connected to said heat exchanger, and an inert gas circulating passage connected to a conduit connecting said heat exchanger and said cooling tank.

3 Claims, 1 Drawing Figure

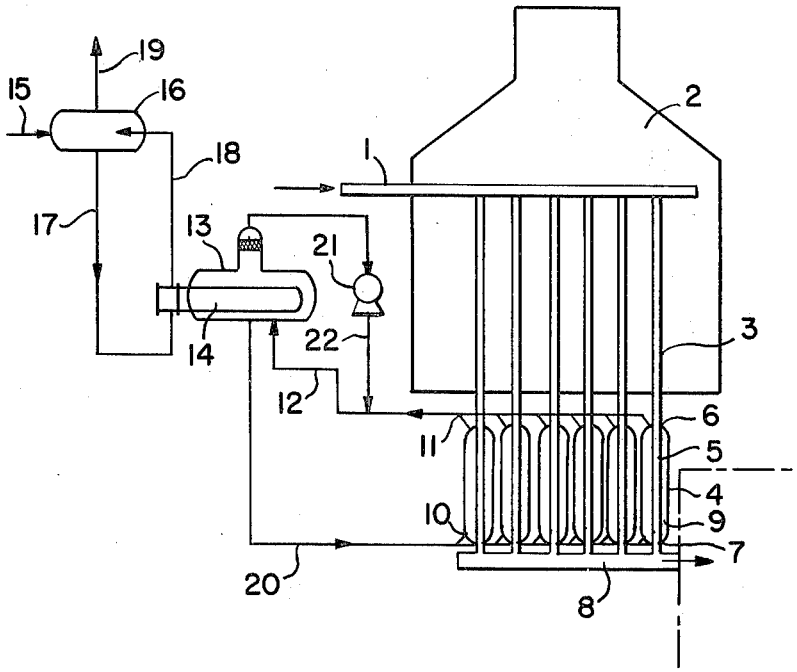
19
15
16
18
17
13
21
14
22
12
1
2
3
6
5
4
9
7
11
10
20
8

METHOD FOR RAPID COOLING OF THERMALLY CRACKED GASES OF HYDROCARBONS AND APPARATUS FOR CARRYING OUT THE METHOD

This is a continuation of Ser. No. 393,212, filed Aug. 30, 1973 now abandoned.

BACKGROUND OF THE INVENTION

This invention relates to a novel method for rapid cooling of high temperature reaction gases obtained by thermal cracking of hydrocarbons and to a novel apparatus utilizable for practice of said method.

Methods for obtaining hydrocarbon products of a high commercial value such as olefins, e.g., ethylene, propylene and aromatic hydrocarbons, e.g., benzene and toluene, which methods comprise cooling high temperature reaction gases obtained by thermal cracking of the starting hydrocarbon materials such as naphtha, kerosene and heavy oil and conducting separation and purification of the gases have been known in the art.

In these conventional methods for thermal cracking of hydrocarbons, it is an important technical problem how to cool the resulting high temperature reaction gas rapidly and effectively. The high temperature reaction gas is generally kept at a temperature of 750° to 900° C. and at such high temperature olefins and aromatic hydrocarbons tend to cause undesired secondary reactions. If they are allowed to stand at such high temperature for a long period of time, therefore, they are converted to carbon and heavy oil or methane and hydrogen.

As means for cooling such thermally cracked gases, there has generally been adopted a method in which high pressure water is used as a cooling medium and an indirect heat exchange is conducted between said cooling medium and a high temperature reaction gas.

In this method, however, considerable coking takes place in the heat exchanger during the rapid cooling step and the resulting coke adheres to the inner walls of heat exchanger tubes, thus resulting in clogging of the tubes. Accordingly, the pressure loss in the reaction gas increases in a very short period of time and coincidentally, the pressure inside the thermal cracking apparatus increases. This results in such disadvantages as reduction of yields of olefins. In the conventional rapid cooling method, therefore the operation of the apparatus system should be halted for a while in order to remove mechanically coke formed in the apparatus system. This is a great economical disadvantage.

SUMMARY OF THE INVENTION

It is therefore a primary object of this invention to provide a method for rapid cooling of high temperature gases formed by thermal cracking of hydrocarbons wherein condensation of heavy components contained in the high temperature gas is substantially prevented.

It is another object of this invention to provide a method for rapid cooling of high temperature gases formed by thermal cracking of hydrocarbons wherein a molten metal is used as a cooling medium and is easily circulated by the use of a pressurized inert gas.

It is still another object of this invention to provide a high temperature gas cooling apparatus utilizable for practice of such method, which comprises a double-tubular heat exchanger, a cooling tank and an inert gas circulating passage connected to a conduit connecting said heat exchanger and said cooling tank.

Other objects and advantages of this invention will be apparent from the following detailed description and the accompanying drawing which is a diagram illustrating an apparatus system utilizable for practice of this invention.

DETAILED DESCRIPTION OF THE INVENTION

In accordance with this invention, there is provided a method for rapid cooling of high temperature reaction gases obtained by thermal cracking of hydrocarbons, characterized in that an indirect heat exchange is effected between said high temperature reaction gases and a molten metal maintained at a prescribed temperature, whereby condensation of heavy components contained in said high temperature reaction gases is substantially prevented.

Utilizable in this case as the high temperature reaction gases, are reaction gases obtained by thermal cracking of naphtha, kerosene, heavy oil and the like. The gas composition varies depending on the kind of the starting crude oil and thermal cracking conditions. In general, such thermally cracked gases are kept at a temperature of 750°–900° C. Incidentally, specific procedures and conditions are such thermal cracking are well known among those skilled in the art.

In order to obviate occurrence of undesired reactions such as coking, such high temperature reaction gas is fed to a heat exchanger and is brought into indirect heat-exchange with a molten metal maintained at such a temperature as will not cause condensation of heavy components, whereby the gas is rapidly cooled to a temperature at which valuable components contained in the gas, such as olefins and aromatic hydrocarbons, do not undergo undesired secondary reactions, generally to a temperature lower than 650° C. In this operation, the heat exchange temperature has great significance in inhibition of coking of hydrocarbons. According to this invention, by adjusting the temperature of the molten metal used as a cooling medium, the temperature of the heat exchanger wall can be maintained within a prescribed range and condensation of heavy components contained in the reaction gas, such as tar and gum, is substantially prevented. By the term "heavy component" used herein is meant a component formed by thermal polymerization or thermal condensation in the course of the thermal cracking reaction, which has a boiling point of about 300° C, and is converted to tar or gum when cooled. The composition or boiling point of such heavy component varies according to the kind of the crude hydrocarbon used in the thermal cracking reaction and the thermal cracking conditions. Thus, the rapid cooling temperature cannot be defined only on one factor. However, it is generally so adjusted that the tube wall temperature of the heat exchanger on the side of exit (the temperature of the introduced molten metal) is kept at 380°– 470° C. in the case of kerosene (distillation point of 160°– 250° C. according to ASTM), 430°– 500° C. in the case of more volatile light oil (distillation point of 210°– 350° C. according ASTM) or 480°– 550° C. in the case of less volatile light oil (distillation point of 230°– 400° C. according to ASTM). When the rapid cooling temperature is kept within such range, condensation of heavy components is inhibited in the heat exchanger and adhesion of the condensate on the tube wall or occurrence of coking is remarkably prevented. The rapid cooling temperature (tube wall temperature) can readily be controlled by adjusting the amount of the molten metal circulated.

In this invention, the use of a molten metal as cooling medium is indispensable to attain said rapid cooling effectively. In case high pressure water generally used as cooling medium is employed in this invention, it is impossible to accomplish rapid cooling effectively. Because of the limitation of critical temperature, it is very difficult to obtain high pressure saturated water of a temperature of 330°– 340° C. or higher. From the economical viewpoint, the use of such highly heated water is impermissible. Thus, metals having a melting point of 300°– 500° C. are generally used in this invention. Such metals include, for example, lead, lead alloy, tin, tin alloy and bismuth. Since melts of these metals have a good heat conductivity, indirect heat exchange can be accomplished very quickly between the melts of these metals and the high temperature gases. Since any particular vapor pressure is not generated, no particular difficulty is brought about in the circulation operation of the molten metals. In accordance with a preferred embodiment of this invention, an inert gas such as nitrogen gas is fed under pressure to a conduit connecting between the outlet for the molten metal from the quick cooling heat exchanger and a cooling tank, whereby the circulation flow of the molten metal can be facilitated by an ascending flow of inert gas.

The reaction gas which has been cooled rapidly has, in general, a temperature of 650° C. or lower at which undersired secondary reactions such as thermal polymerization will not take place among valuable components contained in the reaction gas. Accordingly, such reaction gases can be cooled easily according to a conventional cooling means without accompanying any particular technical difficulties. The cooled reaction gases are fractioned by conventional separation means, such as distillation, into individual valuable components which are then recovered.

This invention will now be described in more detail with reference to the accompanying drawing.

A starting hydrocarbon is introduced from an inlet 1 into a reaction tube 3 disposed in a multi-tubular thermal cracking furnace 2, where the hydrocarbon is thermally cracked at a temperature of 750°– 900° C. The resulting high temperature reaction gas is withdrawn from the reaction tube 3 and then introduced into a heat exchanger 4 for rapid cooling connected to the reaction tube 3. This heat exchanger 4 is a double-tubular heat exchanger comprising an inner tube 5 and an outer tube 9. One end of the inner tube is connected as a gas inlet 6 to the above reaction tube 3. The high temperature reaction gas is introduced from this inlet 6 into the interior of the heat exchanger 4 where the gas is rapidly cooled. The gas is discharged out of the system from a gas exit 7 via a connecting conduit 8. An inlet 10 for a molten metal is disposed in the neighborhood of the gas exit 7 of the outer tube 9, and from the inlet 10 a molten metal as cooling medium is introduced counter-currently to the high temperature reaction gas. After heat exchange has been completed, the molten metal is withdrawn from an outlet 11 for the molten metal disposed in the neighborhood of the gas inlet 6 of the outer tube 9. The withdrawn molten metal passes through a conduit 12 and is introduced into a cooling tank 13 from the lower portion thereof. This cooling tank 13 is installed with a cooling tube 14 into which cooling water is introduced through a conduit 17 from a cooling water inlet 15 of a stream generator 16. This cooling water is heat-exchanged with the molten metal in the cooling tank 13, passed through a conduit 18 and recovered in the form of high pressure steam from a conduit 19 of the steam generator. The high pressure steam thus recovered is utilizable effectively for various purposes. The molten metal, which has been cooled to the prescribed temperature in the cooling tank 13, is passed though a conduit 20 and introduced into the inlet 10 for the molten metal. The circulation of the molten metal between the heat exchanger 4 and the cooling tank 13 through the conduits 12 and 20 can be accomplished spontaneously by locating the cooling tank 13 at a position sufficiently higher than the position of the heat exchanger 4, thereby taking advantage of change in density of the molten metal caused by variation of the temperature. However, it is advantageous and preferred that, as is shown in the drawing the apparatus may be provided with a conduit 22 which connects the head of the cooling tank 13 through pump 21 to one portion of conduit 12, extending between the outlet 11 for molten metal from heat exchanger 4 and cooling tank 13, to form a circulation gas passage consisting of cooling tank 13, conduit 22, pump 21, conduit 22 and conduit 12. A pressurized inert gas is circulated in this passage and the flow of molten metal is accelerated by the ascending flow of inert gas in conduit 12 to the bottom of cooling tank 13.

The cooled reaction gas discharged through the gas exit 7 and connecting conduit 8 is subjected to the subsequent treatment for separating and recovering valuable components contained therein.

According to the method of this invention adopting the above-mentioned specific rapid cooling procedure, the formation of coke in the heat exchanger for cooling is obviated to enable the continuous operation of the apparatus for a long period of time, thus bringing about great economical advantages. Further, since a molten metal is used in this invention as cooling medium, a cooling temperature suitable for a specific hydrocarbon to be treated can easily be chosen at the time of rapid cooling and the temperature can easily be controlled. This is another advantage of this invention.

This invention will now be illustrated in more detail by way of Examples.

EXAMPLE 1

A thermal cracking reaction was conducted under the conditions set forth below, using steam as diluent in the apparatus system illustrated in the drawing. The resulting reaction gas was rapidly cooled by means of a heat exchanger for rapid cooling having a double-tubular structure including an outer tube in which molten lead was circulated. The circulation of molten lead was effected by the aid of pressurized nitrogen gas. In this Example, the temperature of molten lead was set to a temperature of 400° C. not causing condensation of heavy components contained in the reaction gas.

Properties of Starting Kerosene:
Specific gravity: 0.792
ASTM IBP: 160° C.
10: 183° C.
30: 193° C.
50: 201° C.
70:211° C.
90: 229° C.
EP: 246
Sulfur: 0.236% by weight Paraffin and naphthene: 83% by volume
Olefins: less than 0.5% by volume
Aromatics: 17% by volume
Cracking Conditions:
Cracking temperature: 800° C.
Kerosene flow rate: 1500 Kg/hr
Steam feed rate: 1100 Kg/hr The composition of the product obtained by cracking of the kerosene was as follows (determined at the outlet of the heat exchanger of the double-tubular type for rapid cooling).

| Component | % by weight |
|---|---|
| $H_2$ | 0.7 |
| $CH_4$ | 11.0 |
| $C_2H_4$ | 22.0 |
| $C_2H_6$ | 3.5 |
| $C_3$ fraction | 14.0 |
| $C_4$ fraction | 9.0 |
| $C_5$ to 180° C. fraction | 22.8 |
| Fraction higher than 180° C. | 17.0 |

At the initial stage of the operation, the temperature of the thermally cracked reaction gas at the outlet of the heat exchanger was 450° C., but was elevated to 470° C. after the continuous run for 60 days. During this continuous operation, the pressure loss in the apparatus system was very small, thus showing that the operation could further be continued for a long period of time.

EXAMPLE 2

A thermal cracking reaction was conducted under the conditions set forth below in the apparatus system shown in the drawing by employing steam as diluent, and the resulting reaction gas was rapidly cooled by means of a heat exchanger for rapid cooling of a double-tubular structure including an outer tube in which molten lead was circulated by the aid of pressurized nitrogen gas. In this Example, the temperature of molten lead was adjusted to 380° C. at the inlet and 480° C. at the outlet so that condensation of heavy components contained in the reaction gas could be prevented.

Properties of Starting Kerosene:
Specific gravity: 0.8020
ASTM IBP : 156° C.
10 : 175° C.
30 : 187° C.
50 : 198° C.
70 : 212° C.
90 : 234° C.
EP : 251° C.
Sulfur : 0.123% by weight
Cracking Conditions:
Cracking temperature : 850° C.
Kerosene flow rate : 1100 Kg/hr
Steam feed rate : 1100 Kg/hr The composition of the product obtained by thermal cracking of the kerosene was as follows (determined at the outlet of the heat exchanger of the double-tubular system for rapid cooling);

| Component | % by weight |
|---|---|
| $H_2$ | 0.8 |
| $CH_4$ | 10.6 |
| $C_2H_4$ | 26.4 |
| $C_2H_6$ | 2.5 |
| $C_3$ fraction | 12.8 |
| $C_4$ fraction | 7.9 |
| $C_5$ to 180° C. fraction | 23.0 |
| Fraction higher than 180° C | 16.0 |

At the initial stage of the operation, the temperature of the reaction gas was 566° C. at the outlet of the heat exchanger. Even after the operation had been conducted continuously for 20 days, this temperature was not changed and no increase in the pressure loss was observed. Thus, the apparatus system was put in a condition possible for further continuous operation.

COMPARATIVE EXAMPLE

A thermal cracking reaction was conducted under the same conditions as in the Example 1 except that at the initial stage of the operation the temperature of molten lead at the inlet on the cooling side of the double-tubular heat exchanger for rapid cooling was adjusted to 340° C. at which condensation of heavy components in the reaction gas took place to some extent. In this case, the temperature of the cracked gas at the outlet was 450° C. The composition of the gas obtained by thermal cracking of kerosene was as follows:

| Component | % by weight |
|---|---|
| $H_2$ | 0.7 |
| $CH_4$ | 11.0 |
| $C_2H_4$ | 22.0 |
| $C_2H_6$ | 3.5 |
| $C_3$ fraction | 13.8 |
| $C_4$ fraction | 9.0 |
| $C_5$ to 180° C. fraction | 22.9 |
| Fraction higher than 180° C. | 17.1 |

After the operation had been conducted continuously for 20 days, the temperature of the cracking reaction gas at the outlet of the heat exchanger of the duble-tubular system was found to rise to 510° C. and the pressure loss was considerable. Accordingly, the operation could not but be stopped at this stage.

The results of the foregoing Examples and Comparative Example, shows that if the temperature of the gas at the outlet of the heat exchanger of the double-tubular structure was maintained at the same level, the higher the temperature of a molten metal at the inlet, the smaller the amount of coke formed. It will readily be undertood that when the temperature of a molten metal introduced as cooling medium into the heat exchanger is maintained at a level higher than the dew point of heavy components contained in the reaction gas and the tube wall temperature of the heat exchanger is elevated, adhesion of the heavy components onto the tube wall can be prevented and formation of coke can significantly be reduced.

What we claim is:

1. In an indirect method of rapid cooling of high temperature reaction gases containing heavy components which can form coke on heat exchanger walls and having a temperature of at least about 750° C and obtained by thermal cracking of hydrocarbons by passing said gases through a rapid cooling countercurrent flow heat exchanger cooled by a liquid heat exchange medium, the improvement comprising the steps of circulating a molten metal heat exchange medium between a cooling tank and said rapid cooling heat exchanger and introducing said molten metal medium into said rapid cooling heat exchanger countercurrently to said reaction gases at a temperature selected within the range of about 380°–550° C and above the dew point of the cokable components in said reaction gases.

2. A method according to claim 1 wherein said molten metal is selected from the group consisting of lead, lead alloy, tin, tin alloy and bismuth.

3. A method according to claim 1 wherein said molten metal is molten lead and the temperature of said molten lead is adjusted to 380° to 400° C at the inlet and to 480° C at the outlet.

* * * * *